US012121190B1

(12) United States Patent
King

(10) Patent No.: US 12,121,190 B1
(45) Date of Patent: Oct. 22, 2024

(54) EXTENDABLE TOILET FOOT REST

(71) Applicant: Tiffany King, Atlanta, GA (US)

(72) Inventor: Tiffany King, Atlanta, GA (US)

( * ) Notice: Subject to any disclaimer, the term of this patent is extended or adjusted under 35 U.S.C. 154(b) by 92 days.

(21) Appl. No.: 17/903,115

(22) Filed: Sep. 6, 2022

(51) Int. Cl.
*A47K 17/02* (2006.01)

(52) U.S. Cl.
CPC ..... *A47K 17/028* (2013.01)

(58) Field of Classification Search
CPC ..... A47K 17/028
USPC ..... 4/254, 902; 182/223, 33.5; 297/423.2, 297/423.36
See application file for complete search history.

(56) References Cited

U.S. PATENT DOCUMENTS

| | | | | |
|---|---|---|---|---|
| 4,584,725 | A | 4/1986 | Oliver | |
| 8,317,268 | B2 | 11/2012 | Alkhattaf | |
| 9,895,036 | B2 | 2/2018 | Edwards | |
| D840,166 | S | 2/2019 | Nethercott | |
| D896,537 | S | 9/2020 | Lositisuk | |
| 10,881,256 | B1 * | 1/2021 | Luque, Jr. | A47K 17/028 |
| 11,083,350 | B2 | 8/2021 | Slothower | |
| 2009/0178189 | A1 * | 7/2009 | Arroyo | A47K 17/026 4/254 |
| 2010/0257663 | A1 * | 10/2010 | Willner | A47K 17/02 4/254 |
| 2010/0263114 | A1 | 10/2010 | Nagy | |
| 2011/0247898 | A1 * | 10/2011 | Wigutoff | E06C 1/005 182/223 |
| 2012/0234630 | A1 * | 9/2012 | Havens | A47C 12/00 182/223 |

FOREIGN PATENT DOCUMENTS

| | | |
|---|---|---|
| WO | 2019066721 | 4/2019 |

* cited by examiner

*Primary Examiner* — Tuan N Nguyen

(57) ABSTRACT

The extendable toilet foot rest comprises a foot rest enclosure and a foot rest extension. The extendable toilet foot may be adapted to elevate a user's feet while the user sits on a toilet during a bowel movement. As a non-limiting example, elevating the user's feet may loosen the puborectalis muscle to straighten the path through the colon for stool to exit via the rectum. The foot rest enclosure may be removably coupled to a floor in front of the toilet. The foot rest extension may slide into and out of the foot rest enclosure. The foot rest extension may be adapted to be pulled out to an open position for the user's feet to rest upon. The foot rest extension may be pushed to a closed position to preclude the foot rest extension from being a tripping hazard.

13 Claims, 7 Drawing Sheets

EXTENDABLE TOILET FOOT REST

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of toilet accessories, more specifically, an extendable toilet foot rest.

Summary of Invention

The extendable toilet foot rest comprises a foot rest enclosure and a foot rest extension. The extendable toilet foot may be adapted to elevate a user's feet while the user sits on a toilet during a bowel movement. As a non-limiting example, elevating the user's feet may loosen the puborectalis muscle to straighten the path through the colon for stool to exit via the rectum. The foot rest enclosure may be removably coupled to a floor in front of the toilet. The foot rest extension may slide into and out of the foot rest enclosure. The foot rest extension may be adapted to be pulled out to an open position for the user's feet to rest upon. The foot rest extension may be pushed to a closed position to preclude the foot rest extension from being a tripping hazard.

An object of the invention is to elevate the user's feet during a bowel movement.

Another object of the invention is to provide a foot rest enclosure that removably couples to the floor in front of a toilet.

A further object of the invention is to provide a foot rest extension that slides into and out of the foot rest base.

Yet another object of the invention is to slide the foot rest extension to an open position for supporting the user's feet in an elevated position during use and to a closed position when not in use.

These together with additional objects, features and advantages of the extendable toilet foot rest will be readily apparent to those of ordinary skill in the art upon reading the following detailed description of the presently preferred, but nonetheless illustrative, embodiments when taken in conjunction with the accompanying drawings.

In this respect, before explaining the current embodiments of the extendable toilet foot rest in detail, it is to be understood that the extendable toilet foot rest is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the extendable toilet foot rest.

It is therefore important that the claims be regarded as including such equivalent construction insofar as they do not depart from the spirit and scope of the extendable toilet foot rest. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
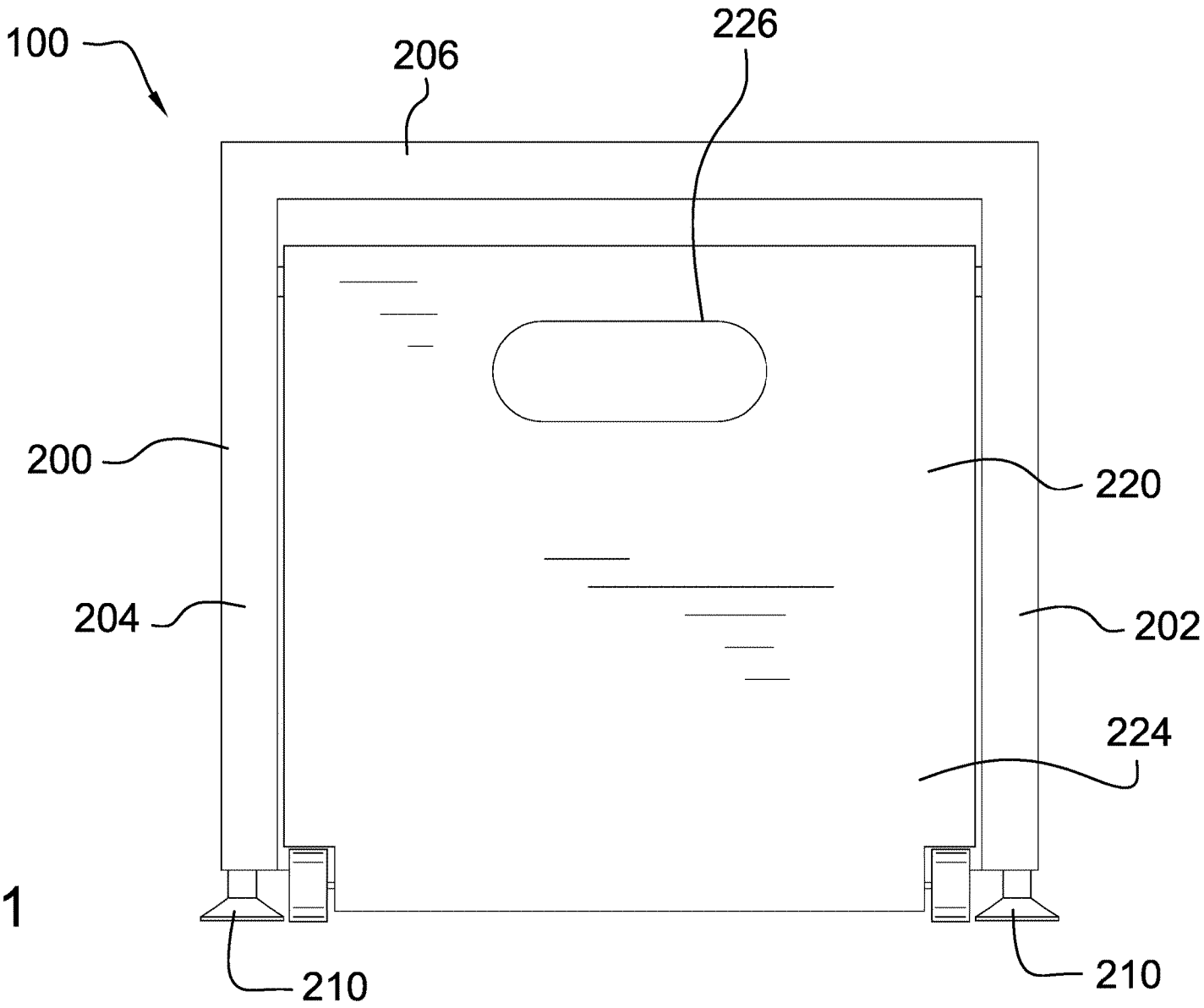
FIG. 1 is a front view of an embodiment of the disclosure.
Figure 2:
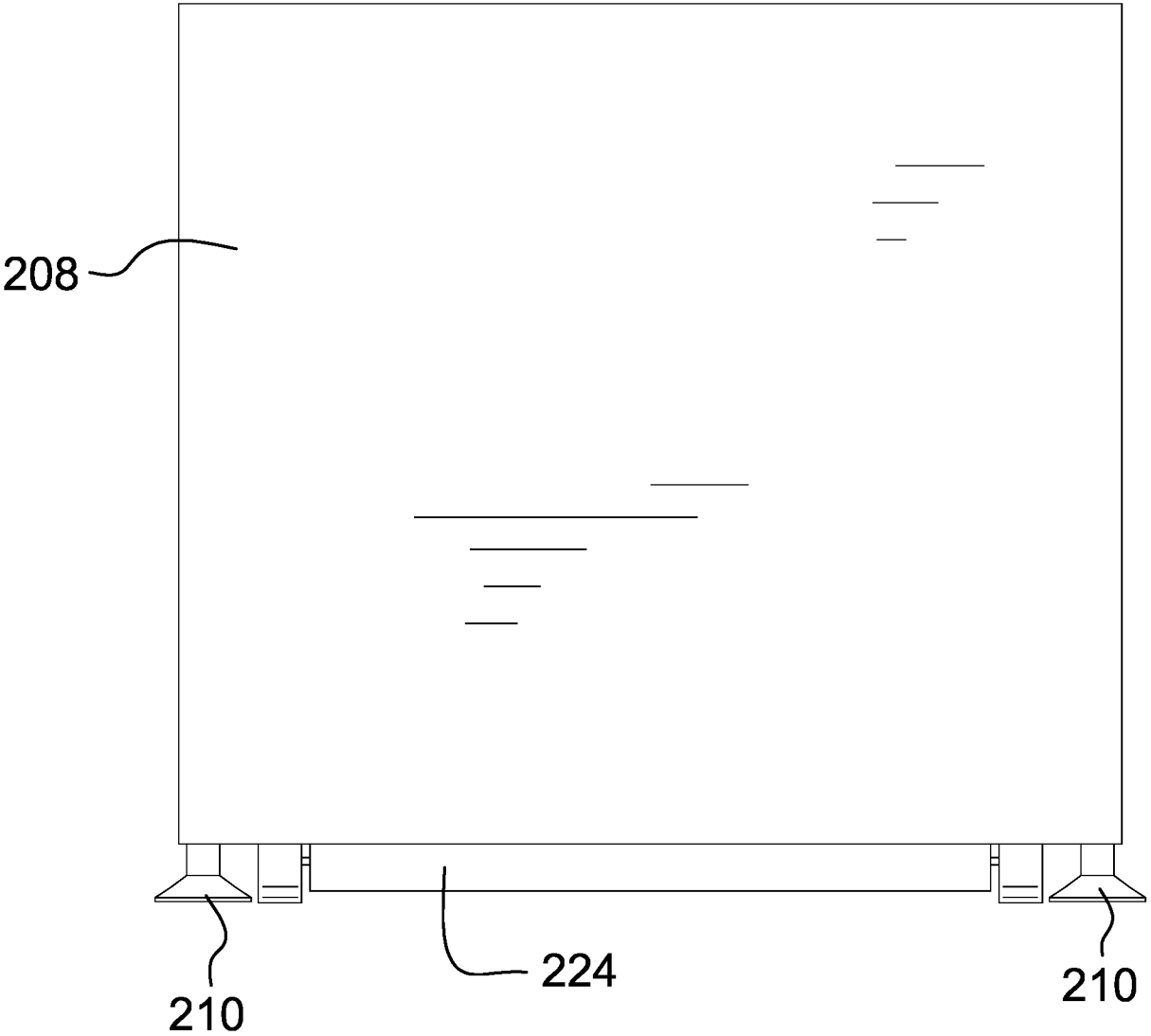
FIG. 2 is a rear view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Detailed reference will now be made to a first potential embodiment of the disclosure, which is illustrated in FIGS. 1 through 7.

The extendable toilet foot rest 100 (hereinafter invention) comprises a foot rest enclosure 200 and a foot rest extension 220. The invention 100 may be adapted to elevate a user's feet while the user sits on a toilet 900 during a bowel movement. As a non-limiting example, elevating the user's feet may loosen the puborectalis muscle to straighten the path through the colon for stool to exit via the rectum. The foot rest enclosure 200 may be removably coupled to a floor 910 in front of the toilet 900. The foot rest extension 220 may slide into and out of the foot rest enclosure 200. The foot rest extension 220 may be adapted to be pulled out to an open position 290 for the user's feet to rest upon. The foot rest extension 220 may be pushed to a closed position 292 to preclude the foot rest extension 220 from being a tripping hazard. The invention 100 may be located under the overhang at the front of a toilet bowl 902 when placed on the floor 910 directly in front of a toilet base 904.

Figure 3:
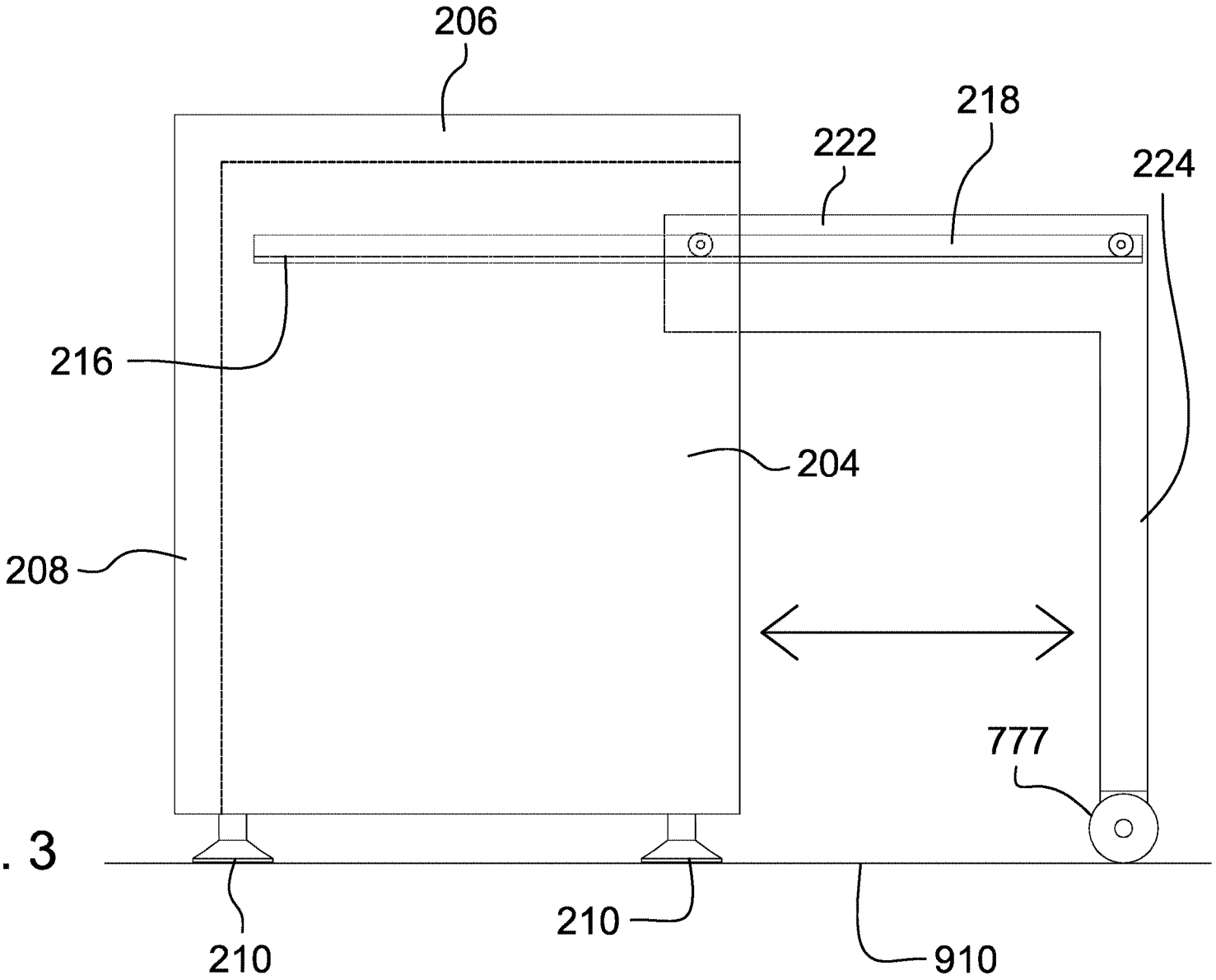
FIG. 3 is a side view of an embodiment of the disclosure.
Figure 4:
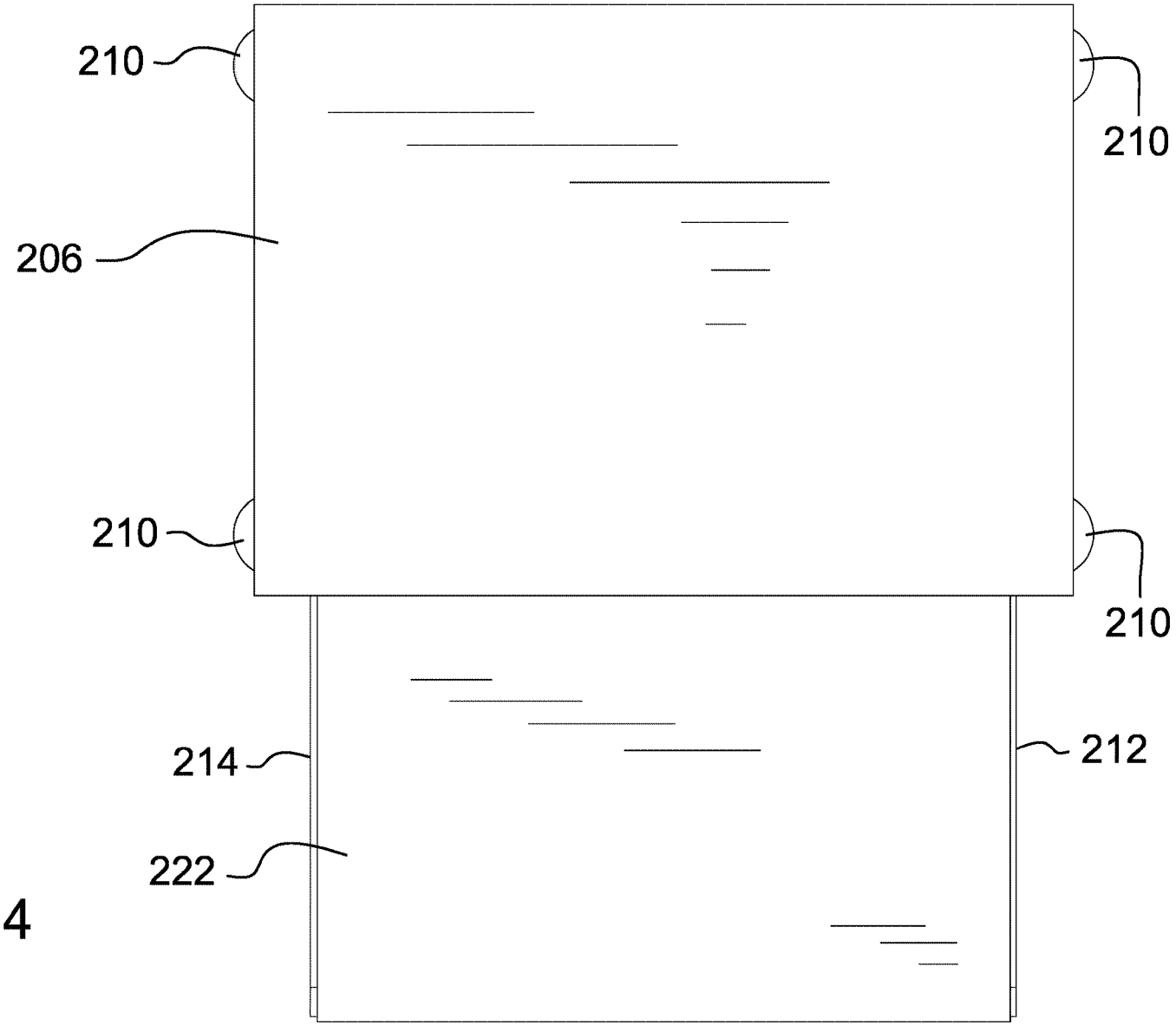
FIG. 4 is a top view of an embodiment of the disclosure.
Figure 5:
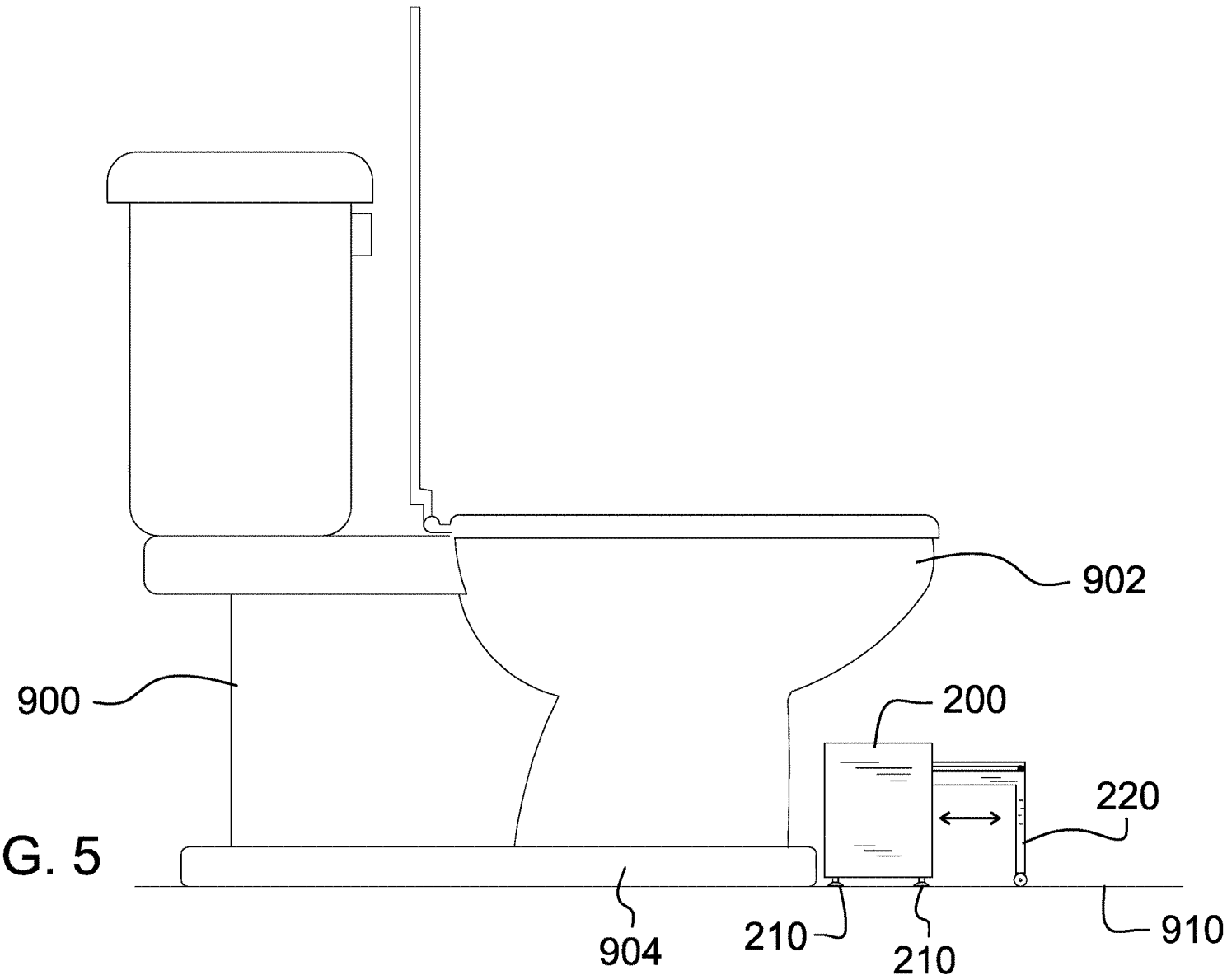
FIG. 5 is an in-use view of an embodiment of the disclosure illustrating the invention in place in front of a toilet.
Figure 6:
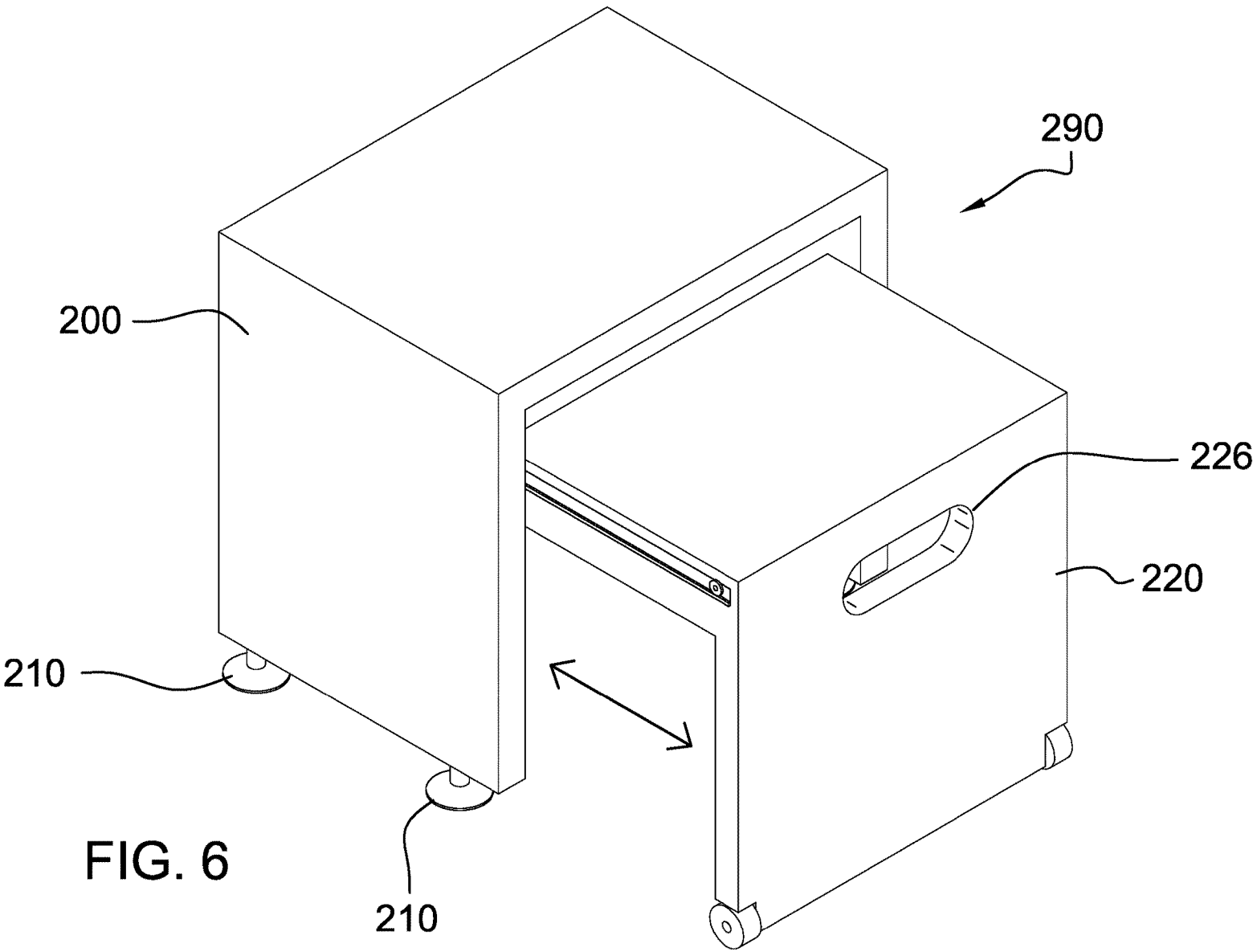
FIG. 6 is an in-use view of an embodiment of the disclosure illustrating the foot rest extension in the open position.
Figure 7:
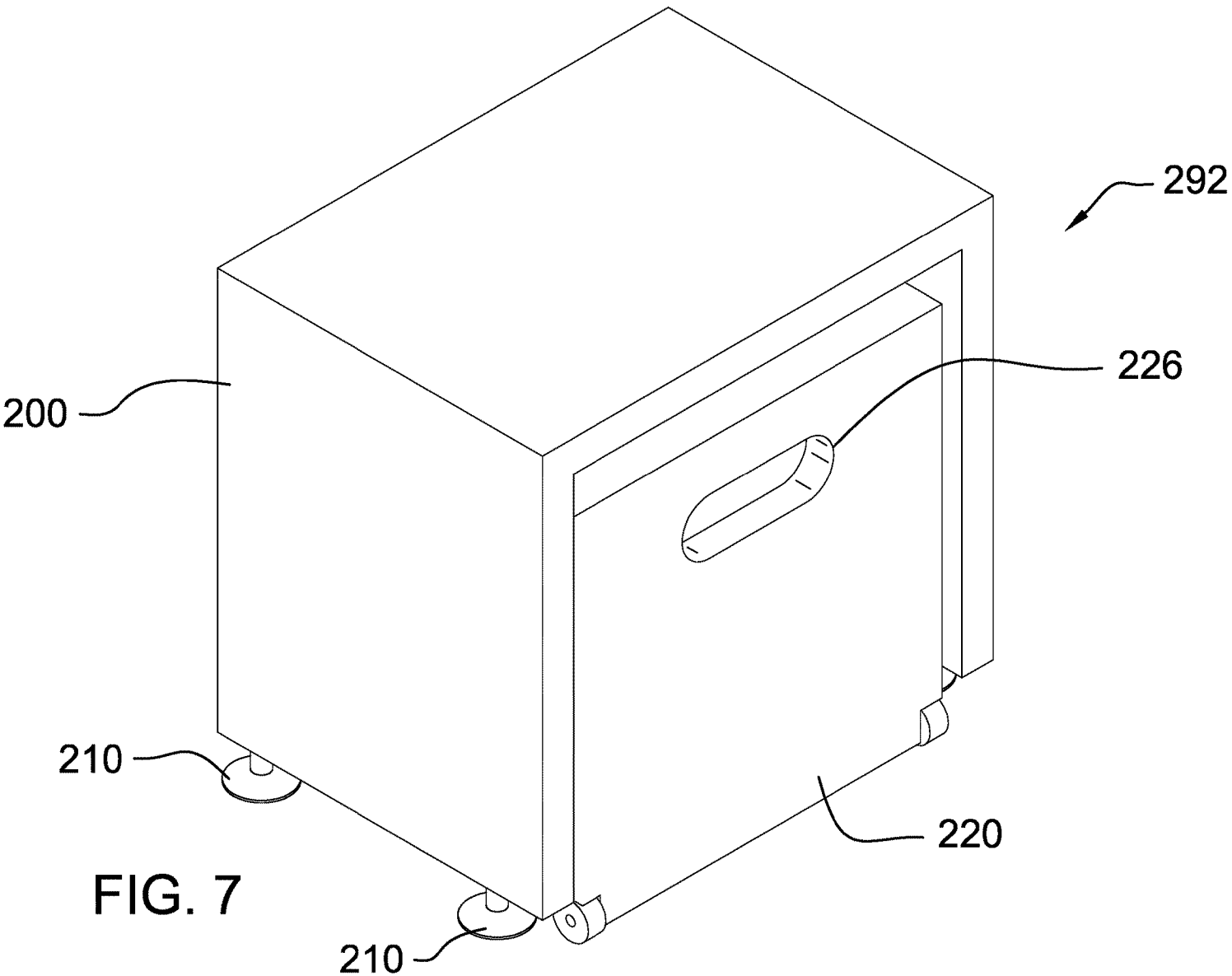
FIG. 7 is an in-use view of an embodiment of the disclosure illustrating the foot rest extension in the closed position.

It shall be noted that the foot rest extension 220 may include wheels 777 to make movement of the foot rest extension 220 easier when extending and retracting (see FIGS. 3 and 5).

The foot rest enclosure 200 may be a supporting stand for the foot rest extension 220. The foot rest enclosure 200 may remain stationary while the foot rest extension 220 slides into and out of the foot rest enclosure 200 via lockable wheels 333. The foot rest enclosure 200 may be the shape of a rectangular cuboid. The foot rest enclosure 200 may comprise an enclosure left side panel 202, an enclosure right side panel 204, and an enclosure top panel 206. The front of the foot rest enclosure 200 may be open. The foot rest enclosure 200 may comprise an enclosure rear panel 208 to strengthen the foot rest enclosure 200.

The foot rest enclosure 200 may comprise a plurality of suction cups 210. The plurality of suction cups 210 may be located on the bottom front of the enclosure left side panel 202, the bottom rear of the enclosure left side panel 202, the bottom front of the enclosure right side panel 204, and the bottom rear of the enclosure right side panel 204. The plurality of suction cups 210 may detachably couple the foot rest enclosure 200 to the floor 910 such that the foot rest enclosure 200 is retained in place directly in front of the toilet base 904.

The foot rest enclosure 200 may be no wider than the width of the toilet bowl 902. The foot rest enclosure 200 may extend forward from the toilet base 904 no farther than the front of the toilet bowl 902.

The foot rest enclosure 200 may comprise a left drawer slide 212 and a right drawer slide 214 located on the inside of the foot rest enclosure 200. The left drawer slide 212 and the right drawer slide 214 may be horizontally oriented and parallel to each other. The left drawer slide 212 may be coupled to the enclosure left side panel 202. The right drawer slide 214 may be coupled to the enclosure right side panel 204. An individual drawer slide selected from the left drawer slide 212 and the right drawer slide 214 may comprise a stationary member 216 and a sliding member 218. The stationary members 216 of the left drawer slide 212 and the right drawer slide 214 may be coupled to the foot rest enclosure 200. The sliding members 218 of the left drawer slide 212 and the right drawer slide 214 may be coupled to the foot rest extension 220.

The foot rest extension 220 may comprise an extension top panel 222 and an extension front panel 224. The foot rest extension 220 may have an inverted L-shape when viewed from a side.

The extension top panel 222 may be horizontally oriented. The sliding member 218 of the left drawer slide 212 may be coupled to the left side of the extension top panel 222. The sliding member 218 of the right drawer slide 214 may be coupled to the right side of the extension top panel 222. The extension top panel 222 may slide out of the foot rest enclosure 200 when the foot rest extension 220 is in the open position 290. The extension top panel 222 may be adapted to support the user's feet when the foot rest extension 220 is in the open position 290. The extension top panel 222 may slide into the foot rest enclosure 200 when the foot rest extension 220 is in the closed position 292.

The extension front panel 224 may be vertically oriented. The top of the extension front panel 224 may be coupled to the front of the extension top panel 222. The bottom of the extension front panel 224 may rest upon the floor 910 such that the extension front panel 224 may be adapted to support the weight of the user's feet on the extension top panel 222.

The extension front panel 224 may comprise a grasping aperture 226. The grasping aperture 226 may be adapted for the user to grasp while sliding the foot rest extension 220 into or out of the foot rest enclosure 200.

The width of the foot rest extension 220 may be less than the width of the front opening of the foot rest enclosure 200 as measured from the inside wall of the enclosure left side panel to the inside wall of the enclosure right side panel 204.

The height of the foot rest extension 220 as measured from the floor 910 to the top surface of the extension top panel 222 may be less than the height of the front opening of the foot rest enclosure 200 as measured from the floor 910 to the underside of the enclosure top panel 206.

In use, the foot rest enclosure 200 may be positioned directly in front of the toilet 900 such that the foot rest enclosure 200 is located under the front overhang of the toilet bowl 902. The foot rest enclosure 200 may be retained in that position by the plurality of suction cups 210. The foot rest extension 220 may slide into the foot rest enclosure 200 when the invention 100 is not in use. The user may sit on the toilet 900 for a bowel movement and may slide the foot rest extension 220 out by grasping the grasping aperture 226 and pulling. The user's feet may then be placed on the top of the foot rest extension 220 and/or on top of the foot rest enclosure 200. Elevating the user's feet may loosen the puborectalis muscle.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" may refer to top and "lower" may refer to the bottom. As a non-limiting example, the upper end of a vertical shaft is the top end of the vertical shaft.

As used in this disclosure, an "aperture" may be an opening in a surface. Aperture may be synonymous with hole, slit, crack, gap, slot, or opening.

As used herein, the words "couple", "couples", "coupled" or "coupling", may refer to connecting, either directly or indirectly, and does not necessarily imply a mechanical connection.

As used herein, "front" may indicate the side of an object that is closest to a forward direction of travel under normal use of the object or the side or part of an object that normally presents itself to view or that is normally used first. "Rear" or "back" may refer to the side that is opposite the front.

As used in this disclosure, "horizontal" may be a directional term that refers to a direction that is perpendicular to the local force of gravity. Unless specifically noted in this disclosure, the horizontal direction is always perpendicular to the vertical direction.

As used herein, the words "invert", "inverted", or "inversion" may refer to an object that has been turned inside out or upside down or to the act of turning an object inside out or upside down.

As used herein, "rectangle" and "rectangular" may refer to a closed figure comprising four straight lines joined by four right angles. The opposing sides of a rectangle have equal length. A square is considered to be a special type of rectangle where all four sides are the same length. An object may still be considered to have a generally rectangular shape even if corners of the object are rounded off as long as two sets of opposing, straight-line, perpendicular sides are apparent.

As used in this disclosure, "vertical" may refer to a direction that is parallel to the local force of gravity. Unless specifically noted in this disclosure, the vertical direction is always perpendicular to horizontal.

With respect to the above description, it is to be realized that the optimum dimensional relationship for the various components of the invention described above and in FIGS. 1 through 7, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. An extendable toilet foot rest comprising:

a foot rest enclosure and a foot rest extension;

wherein the extendable toilet foot rest is adapted to elevate a user's feet while the user sits on a toilet during a bowel movement;

wherein the foot rest enclosure is removably coupled to a floor in front of the toilet;

wherein the foot rest extension slides into and out of the foot rest enclosure;

wherein the foot rest extension is adapted to be pulled out to an open position for the user's feet to rest upon;

wherein the foot rest extension is pushed to a closed position to preclude the foot rest extension from being a tripping hazard;

wherein the extendable toilet foot rest is located under the overhang at the front of a toilet bowl when placed on the floor directly in front of a toilet base;

wherein the foot rest enclosure is the shape of a rectangular cuboid;

wherein the foot rest enclosure comprises an enclosure left side panel, an enclosure right side panel, and an enclosure top panel;

wherein the front of the foot rest enclosure is open;

wherein the foot rest enclosure comprises a plurality of suction cups;

wherein the plurality of suction cups detachably couple the foot rest enclosure to the floor such that the foot rest enclosure is retained in place directly in front of the toilet base;

wherein the foot rest enclosure is a supporting stand for the foot rest extension;

wherein the foot rest enclosure remains stationary while the foot rest extension slides into and out of the foot rest enclosure;

wherein the plurality of suction cups are located on the bottom front of the enclosure left side panel, the bottom rear of the enclosure left side panel, the bottom front of the enclosure right side panel, and the bottom rear of the enclosure right side panel;

wherein the foot rest enclosure comprises a left drawer slide and a right drawer slide located on the inside of the foot rest enclosure;

wherein the left drawer slide and the right drawer slide are horizontally oriented and parallel to each other;

wherein the extension top panel slides out of the foot rest enclosure when the foot rest extension is in the open position;

wherein the extension top panel is adapted to support the user's feet when the foot rest extension is in the open position.

2. The extendable toilet foot rest according to claim 1 wherein the foot rest enclosure comprises an enclosure rear panel to strengthen the foot rest enclosure.

3. The extendable toilet foot rest according to claim 2 wherein the foot rest enclosure is no wider than the width of the toilet bowl;

wherein the foot rest enclosure extends forward from the toilet base no farther than the front of the toilet bowl.

4. The extendable toilet foot rest according to claim 3 wherein the left drawer slide is coupled to the enclosure left side panel;

wherein the right drawer slide is coupled to the enclosure right side panel.

5. The extendable toilet foot rest according to claim 4 wherein an individual drawer slide selected from the left drawer slide and the right drawer slide comprises a stationary member and a sliding member;

wherein the stationary members of the left drawer slide and the right drawer slide are coupled to the foot rest enclosure;

wherein the sliding members of the left drawer slide and the right drawer slide are coupled to the foot rest extension.

6. The extendable toilet foot rest according to claim 5 wherein the foot rest extension comprises an extension top panel and an extension front panel;

wherein the foot rest extension has an inverted L-shape when viewed from a side.

7. The extendable toilet foot rest according to claim 6 wherein the extension top panel is horizontally oriented.

8. The extendable toilet foot rest according to claim 7 wherein the sliding member of the left drawer slide is coupled to the left side of the extension top panel;

wherein the sliding member of the right drawer slide is coupled to the right side of the extension top panel.

9. The extendable toilet foot rest according to claim 8 wherein the extension top panel slides into the foot rest enclosure when the foot rest extension is in the closed position.

10. The extendable toilet foot rest according to claim 9 wherein the extension front panel is vertically oriented.

11. The extendable toilet foot rest according to claim 9 wherein the top of the extension front panel is coupled to the front of the extension top panel;

wherein the bottom of the extension front panel rests upon the floor such that the extension front panel is adapted to support the weight of the user's feet on the extension top panel.

12. The extendable toilet foot rest according to claim 11 wherein the extension front panel comprises a grasping aperture;

wherein the grasping aperture is adapted for the user to grasp while sliding the foot rest extension into or out of the foot rest enclosure;

wherein the foot rest extension include wheels to enable the foot rest extension to aid in extension of and retraction of the foot rest extension.

13. The extendable toilet foot rest according to claim 12 wherein the width of the foot rest extension is less than the width of the front opening of the foot rest enclosure as measured from the inside wall of the enclosure left side panel to the inside wall of the enclosure right side panel;

wherein the height of the foot rest extension as measured from the floor to the top surface of the extension top panel is less than the height of the front opening of the foot rest enclosure as measured from the floor to the underside of the enclosure top panel.

* * * * *